United States Patent [19]

Romney

[11] 4,006,476

[45] Feb. 1, 1977

[54] CHANGEABLE DISPLAY APPARATUS

[76] Inventor: Russell H. Romney, P.O. Box 15657, Salt Lake City, Utah 84115

[22] Filed: May 9, 1975

[21] Appl. No.: 576,127

[52] U.S. Cl. ..... 340/373; 340/336; 40/132 D

[51] Int. Cl.[2] ..... G08B 5/00

[58] Field of Search ..... 340/366 R, 366 G, 366 E, 340/372, 373, 381, 378 R, 336; 317/99; 240/153; 40/130 D, 130 E, 130 J, 132 D

[56] References Cited

UNITED STATES PATENTS

| | | | |
|---|---|---|---|
| 2,740,955 | 4/1956 | Barrett | 340/373 |
| 3,025,512 | 3/1962 | Bloeche | 340/373 |
| 3,487,403 | 12/1969 | Pihl | 340/366 R X |
| 3,530,462 | 9/1970 | Hampel | 340/381 |
| 3,680,083 | 7/1972 | Pihl | 340/373 |
| 3,742,446 | 6/1973 | Wells et al. | 340/366 G |

*Primary Examiner*—John W. Caldwell
*Assistant Examiner*—William M. Wannisky

[57] ABSTRACT

A changeable display apparatus and method is disclosed which is made up of a group of similar individual character modules, disposed in a substantially continuous viewing surface, each module comprising support panel or base and a set of identical and changeable elements so it can represent any desired one of a character group, e.g., any letter of the alphabet. Each display element comprises a molded two-piece housing body designed to pivotally support a rotatable magnetic display piece having a relatively visible light-showing or light-reflective face and a dark or non-visible face which can be moved selectively to a viewing position. Solenoid means individual for rotating each element show a desired face selectively, so that selected elements in any module as desired may be shifted either in unison, or preferably sequentially, to show individual display characters or symbols, such as a letter of the alphabet or an arabic numeral, etc. The light-showing face, per se, is designed preferably to operate essentially without electrical or other energy consumption. Access to mounting means for the elements on the base panel is provided by slightly truncating the corners of each housing body.

10 Claims, 24 Drawing Figures

CHANGEABLE DISPLAY APPARATUS

BACKGROUND AND PRIOR ART

The increasing need to conserve energy has brought an increasing demand for changeable signs and display devices which can provide an effective visual display while using as little power as possible. Modern reflective materials can replace and have often replaced illuminated power-consuming elements, such as electrical light bulbs, for many purposes. However, even where reflective changeable surfaces are used and no power is consumed to produce the actual illumination, considerable power may be required for changing or shifting a display, e.g., as in animated signs. Widely used time and temperature indicating devices, highway control panels, and the like often utilize reflective surfaces but display changing equipment is still costly to operate. A recently developed system described in *The Christian Science Monitor*, Apr. 19, 1973, makes use in a sign of a large number of individual rotatable elements all of which can be remotely controlled by manual, mechanical or computer means for changeable displays. See also "Signs of the Times," October 1974, pp. 48–50.

The present invention has some similarities to those described. It particularly relates to an improved system which also uses interchangeable rotatable visual elements in interchangeable modules each of which is designed to display a selected character with minimal consumption of power. The actual lighting (light-emitting or light-reflecting, etc.) surfaces which show may be of various types such as self-luminous phosphorescent, fluorescent, or merely reflective, and of various shapes and characteristics, as will be explained more fully below. Method aspects of the present invention relate to its unusual economy combined with high quality display characteristics.

DESCRIPTION OF PREFERRED EMBODIMENT

Figure 1:
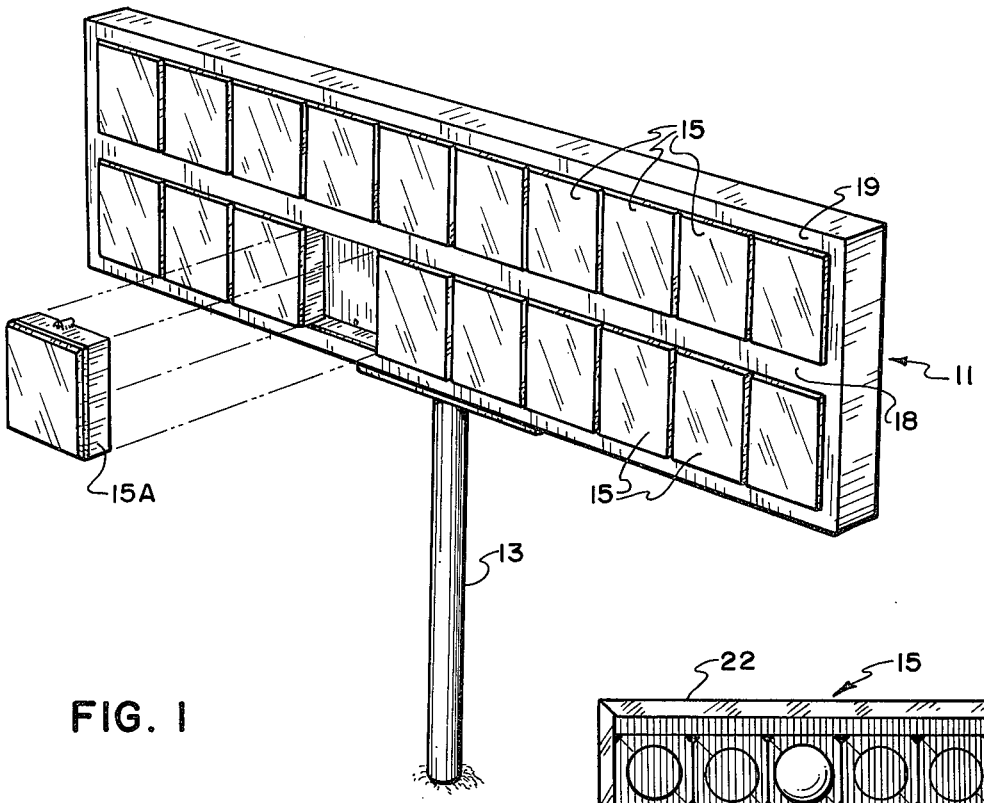
FIG. 1 is an isometric view of a changeable display sign made up of a group of identical character modules, according to a preferred aspect of this invention, one module being shown out of place.

FIG. 1 shows a display sign 11 mounted on a support post 13 which represents a typical but not a limiting embodiment of the invention. This sign is made up of a group of individual modules 15 fitted together in two horizontal rows of 10 modules each, the rows being separated by a divider strip 18. The whole group is surrounded and enclosed by a peripheral frame 19 which may be of any suitable type, as will be readily understood by those skilled in the art. The structure shown, embodying a total of 20 modules 15, as shown in FIG. 1, is exemplary only. Obviously, a lesser or a greater number of modules may be used and they may be arranged in as many rows and/or columns as needed for the display that is desired. The structure of FIG. 1 may be typical, for example, for use as a highway information sign. One module, 15A, is shown as being displaced forwardly from the others and it is desirable to mount all the modules in the supporting structure in such a manner that they may be slid into place and secured there in any suitable manner. These are designed for such insertion and fastening. Preferred mounting means and procedures are described below.

Figure 2:
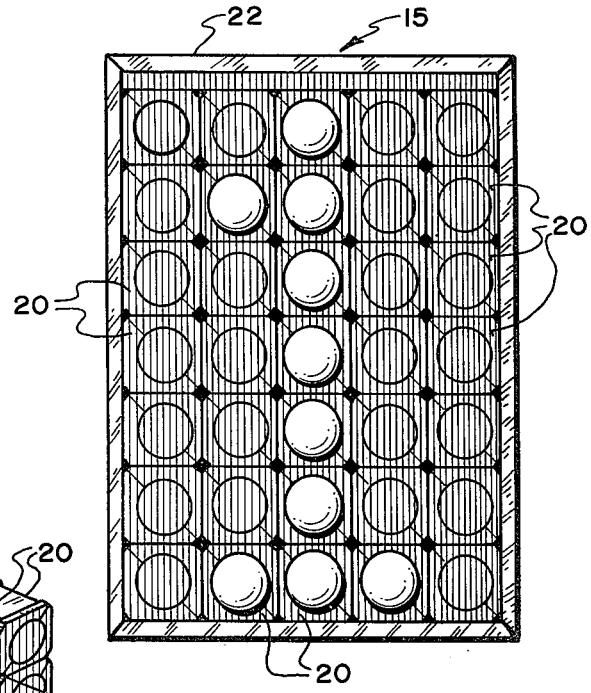
FIG. 2 is a face view of an individual module.
Figure 3:
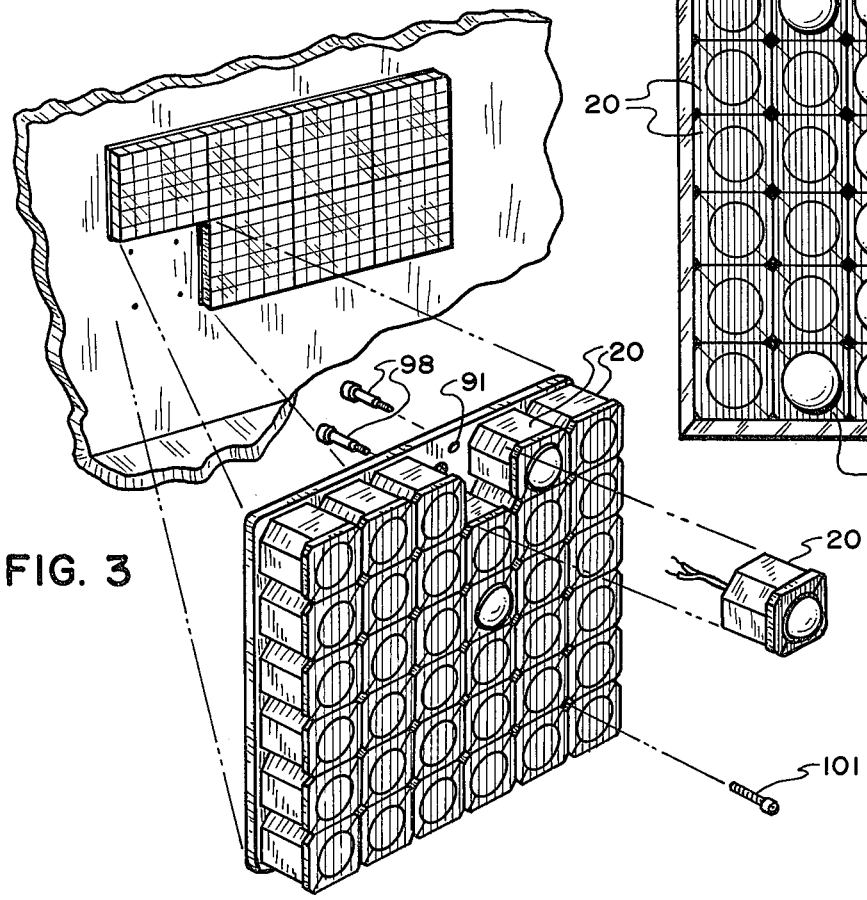
FIG. 3 is another view like FIG. 1, of a modification, showing also a background device.

FIG. 2 shows a single module 15, made up of a total of 35 elements 20 all mounted in a frame 22. These are arranged in five vertical columns of seven elements each. Other arrangements, of course, may be used. A desirable alternative is illustrated in FIG. 3, which shows an assembly of 36 elements 20, in six horizontal rows and six vertical columns. In either case, where it is intended to display alphabetical and/or numerical symbols or characters, as in informational or directing signs, enough display elements are used that each of the letters of the alphabet and/or each of the digital numbers may be distinctly displayed by selecting appropriate movable display parts in the various elements. In FIG. 2, the numeral 1 is shown. By turning into view the chosen or appropriate movable parts, to be described more fully below, any other number or any letter of the alphabet may be displayed, as will be obvious to those skilled in the art. FIGS. 1 and 3 are alternative modifications and, in general, a description of FIG. 1 and the component parts of the structure there shown, will be understood as applicable to FIG. 3.

Figures 4, 5, 6:
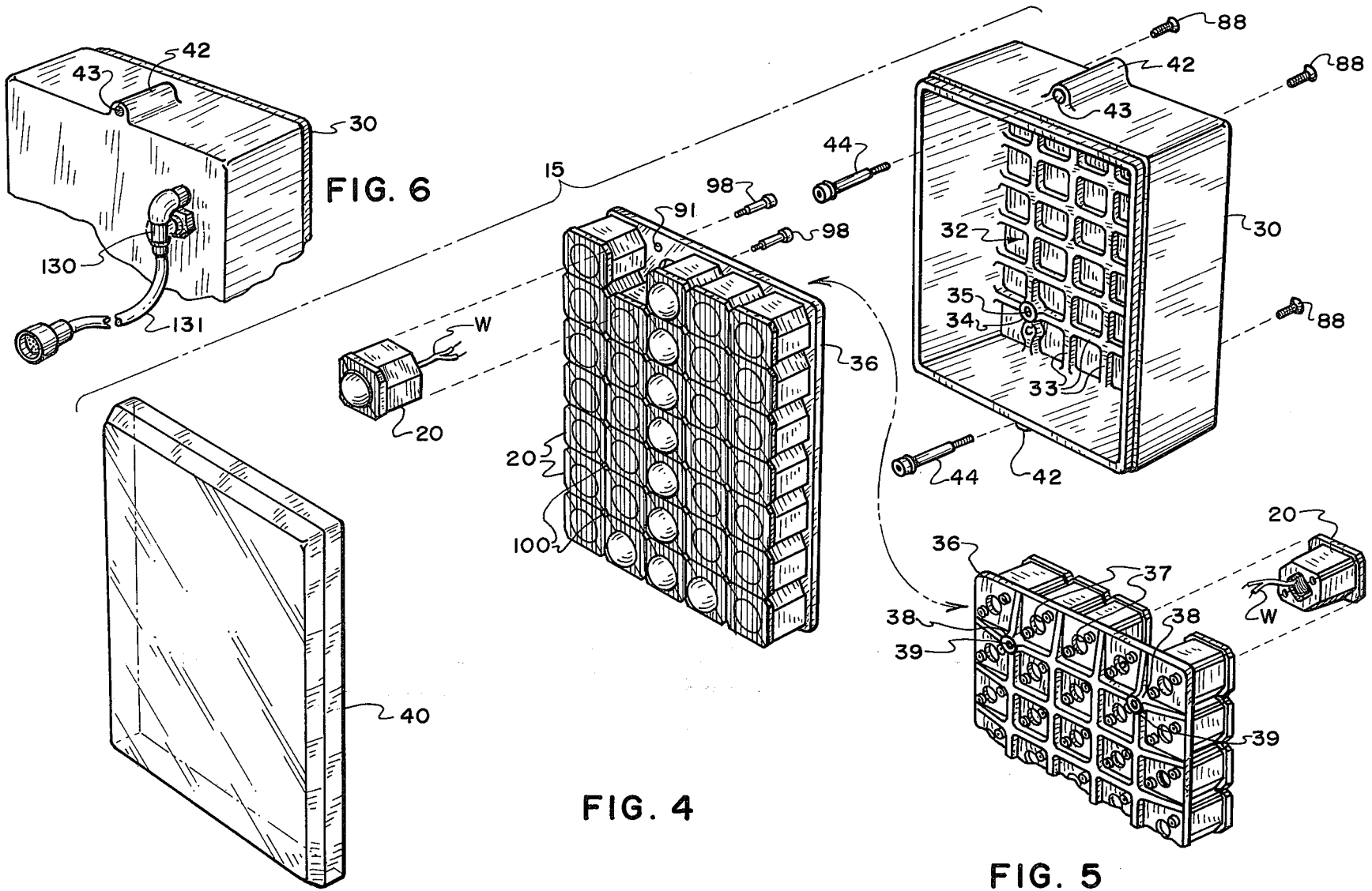
FIG. 4 is an exploded view of an individual and enclosed module, showing details of its construction.
FIG. 5 is an exploded view of a module from the rear, showing structural details.
FIG. 6 is a fragmentary perspective view showing means and method of mounting an individual module of the display apparatus.

FIG. 4 shows an exploded view of a module 15 and a preferred method of building and mounting it, where weather protection is needed. A box 30, molded of a suitable plastic or reinforced resin material, has an imperforate but grid-like rear face 32. The grid-like ribs 33 provide reinforcement for this rear panel, to stiffen it. This box is designed to receive a panel 36 on which the assembly of elements 20 is mounted. This panel 36 is perforated with a hole behind each element, as shown at 37 in FIG. 5 where the parts are reversed, as compared to the middle part of FIG. 4. Electric wires projecting from the rear of each element 20 are passed through these openings 37 and may lie between the panel 36 and the back wall or face 32 of box 30. One element 20 is shown displaced to the right of the panel in FIG. 5.

Figure 10:
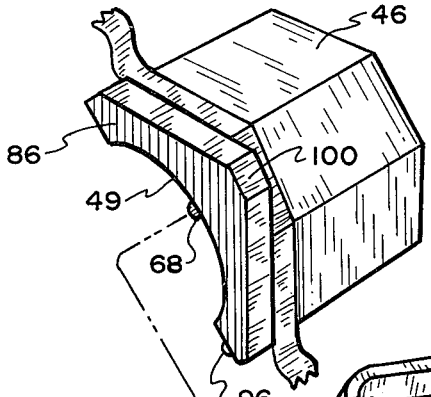
FIG. 10 is a fragmentary sectional view of an arrangement for securing a module from the front.
Figure 10:
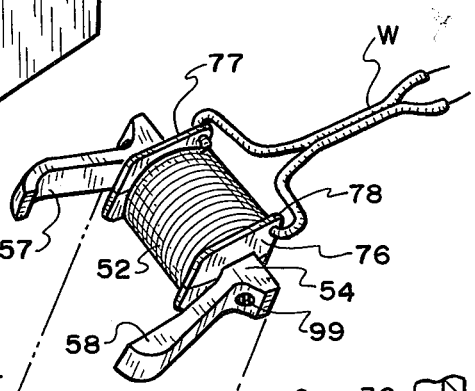
Figure 10:
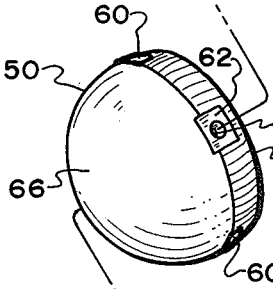
Figure 10:
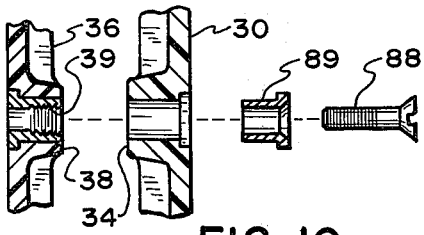

The rear wall 32 of the box is provided with anchoring lugs or blocks 34 made up preferably of metal pieces cast or molded or otherwise inserted into the plastic wall. Each of these is bored through and tapped, as shown at 35, to receive and anchor a screw or bolt 88 which secures the box 30 to a sign support, such as a frame or a wall of a building, not shown. The rear or right side of panel 36, as seen in FIG. 4, middle part, is of course the front or left face as seen in FIG. 5, and the panel 36 may be anchored in the same manner by reinforcement blocks or lugs 38, drilled and tapped at 39 in the same manner as parts 34, just mentioned. This arrangement is shown in FIG. 10, where the screws 88 pass through a bushing 89, through the rear wall of box 30, and are threaded into the tapped openings 39 from the rear.

Figure 11:
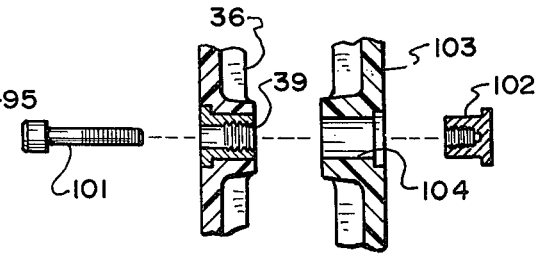
FIG. 11 is a similar view of a fastening from the rear.

Instead of using the threaded openings 35 to receive the front of a bolt which threads into them from a support, as just described, a smaller diameter bolt or screw 101 may be passed through the threaded openings 39, without engaging the threads, and screwed into a backing support, as shown in FIG. 11. Bolt 101 passes through composite openings 97 in the assembled two half-sheet part housing element 20 and through the opening 39 and on through a larger opening 104 in rear support panel or wall 103 (which may be the same wall 32 or may be a different support member) and into a threaded nut 102 which sets in the opening 104.

The independent panel 36, as shown in FIG. 4, is desirable for convenience in assembling the module and, as noted above, it provides for a wire receiving space behind it in front of the rear wall 32 of the module box 30. In some cases, as where weather protection is not needed, the rear wall 32 of box 30, or the whole box in some cases, may be dispensed with in which case the panel 36 is secured directly to a rear supporting surface, in the manner shown in FIG. 10 or in FIG. 11, as described above.

A transparent or at least translucent cover panel 40, FIG. 4, is fitted to enclose the front of box 30 and thus to protect the assembly of elements 20 from the weather. As described further below, each such element includes an electric coil. Hence, an electric current passing through these coils may produce enough heat, due to resistance in the coils, to keep frost and ice from accumulating on the front cover 40. This arrangement can be used then to protect the sign from being blocked out by snow or ice in the coldest of weather. Suitable connections and controls may be used to regulate the current, e.g., a small current may be allowed to flow continuously without changing the display, by appropriate controls and connections.

In FIG. 6, a boss 42, is shown on box 30, in which holes 43 are drilled or molded in the bosses 42 through which pass bolts 44, used as attaching means for appropriate mounting. Box 30 then may be secured to an appropriate frame, wall, or other sign-supporting structure, not shown. Each module 15 may be mounted individually to form a whole row (or column) of modules, as in the case of FIG. 1.

FIG. 5 shows the rear panel 36 in front, with the elements 20 attached to its rear face, as seen in this figure. Electric wires W are passed through openings 37 in panel 36 so they may be extended or connected to control means which are connected in turn to a power source and control mechanism, not shown.

Figure 7:
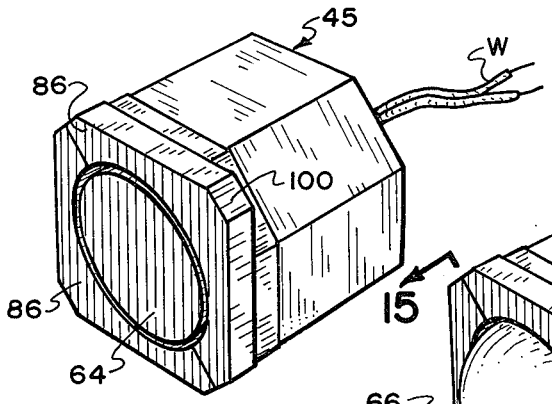
FIG. 7 is a perspective view of a simple display element such as those which make up the module of FIGS. 2 and 4.
Figure 8:
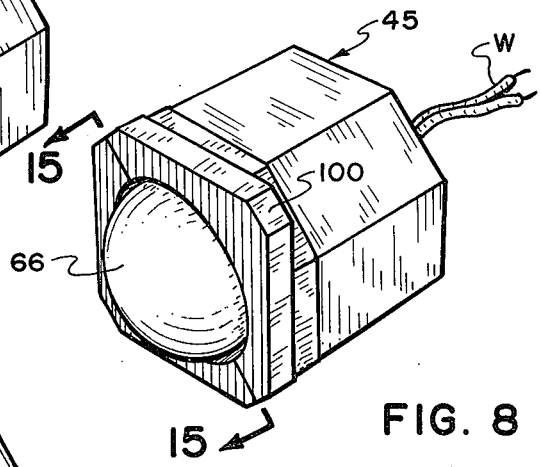
FIG. 8 is a view similar to FIG. 7 with the display piece of the element in a changed position.
Figure 9:
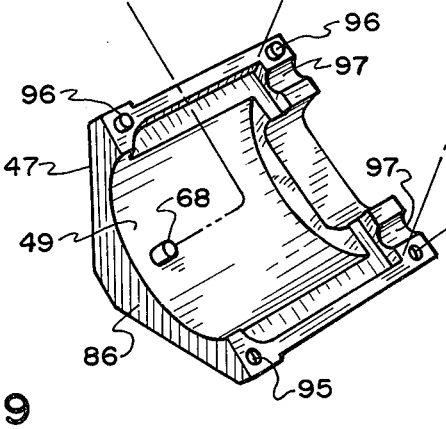
FIG. 9 is an exploded view of the element of FIGS. 6 and 7, showing structural details.
Figure 14:
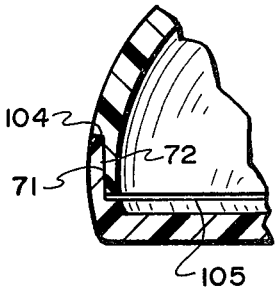
FIG. 14 is a fragmentary sectional view of the display piece.
Figure 15:
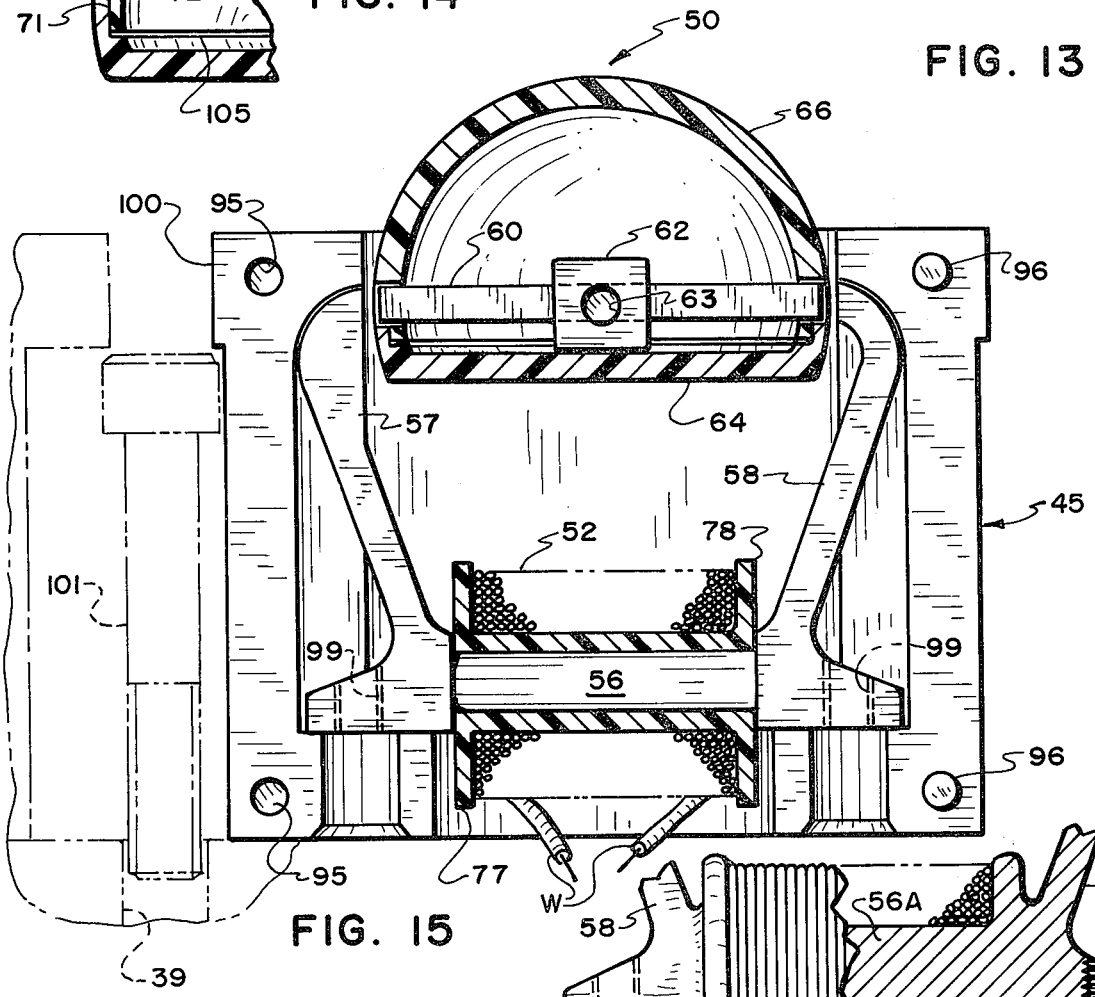
FIG. 15 is an enlarged transverse sectional view through the element of FIGS. 7 to 10, taken substantially along the line 15—15 of FIG. 8.
Figure 16:
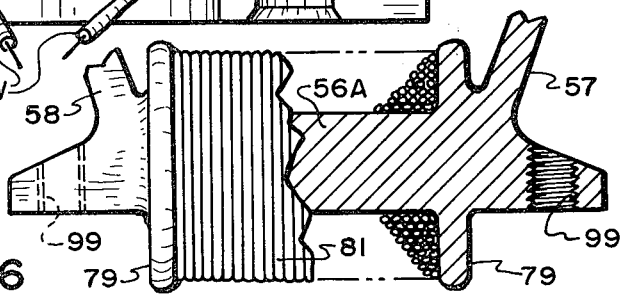
FIG. 16 is a sectional fragmentary view of a modified coil core.

FIG. 7, 8 and 9 show some details of the sign elements 20. Each of them has a two-part molded body or housing 45 consisting of the two identical and interchangeable half shell or half body parts of a strong moldable resin, which may be thermoplastic or thermosetting. The latter often will be preferred. One half 46 of body 45 is shown above and the other half 47 is shown below in FIG. 9. Each half has a half-cylindrical cavity 49 formed in it to accommodate the rotatable face piece 50 as well as to receive the operating coil 52 and magnetic core 54. The latter, as shown at the lower right of FIG. 9, see also FIGS. 15 and 16, is formed of soft iron, preferably sintered or powdered iron, and has a central core part 56 integral with projecting arms, 57, 58 which terminate at points opposite the respective ends of a permanent magnet in the form of a bar 60. Magnet 60 is fitted cross-wise in a molded axle bar or block 62 formed of a tough, strong plastic resin, such as nylon or equivalent. Block 62 serves as a cross axle to support the display piece 50 on pivots for rotation. The latter comprises a light two-part hollow structure formed of moldable plastic material which may in some cases, assume various shapes and forms, but preferably consists of a flat surfaced rear black or dark face cup member 64 and a front face or light-showing (or light-reflecting) member in form of a hollow cup 66. These parts are all shown clearly in FIG. 12. See also FIGS. 13 and 15 for the magnet 60 and axle block 62. The latter is drilled at each end at 63 to receive an axle pin 68; one such pin is fitted into each enclosure body half 46 and 47, to support axle block 62 for free rotation. See FIG. 9. Parts 64 and 66 are rebated as shown at 71, 72, FIG. 14, to fit neatly together. They may be fastened together by a suitable bonding agent or adhesive, after the axle block 62 and magnet bar 60 are in place on the pivot pins. The electric coil 52 is wound around the central core part 56, terminating in wires W which connect it to a power and power-control source, not shown.

When direct electric current in the proper direction is passed through wires W which connect it to a power and power-control source, not shown, that is when an electric current is passed through wires W, the core 56 and its arms 57 and 58 are magnetized to oppose and repel the respective adjacent ends of bar magnet 60. This causes the bar magnet to rotate, along with the axle block 62, by 180 degrees, bringing the opposite face or cup 64 or 66 to the front, thus reversing the display piece. For this particular display element, its aspect is changed either from dark to light, or vice versa each time it turns. This of course requires that the current passing through wire W be reversed for each sequential operation. Current reversal is provided for in the control mechanism as is obvious. Such mechanism forms no part of the present invention, being well known, at least in principle, in the prior art.

The coil 52 is shown in FIG. 9 as being wound around a plastic spool 76 which is formed in two parts, each half being fitted halfway around the central core part 56 and each bearing an end flange part 77 or 78. This core is a convenient form for winding the core wire onto. However, the wire, properly insulated, may be wound directly around the mid-core part 56A, in which case the latter is provided with flanges 79 so to properly confine the coil 81 against spreading laterally. See FIG. 16, for the latter arrangement.

The parts 64 and 66 are notched appropriately at 91 and 92 to receive neatly and respectively the ends of axle bar 62 and of magnet 60. See FIG. 12. The axle bar is mounted for free rotation on the pins 68, as mentioned above, and these pins, whose ends engage the bottoms of the drilled holes 63, keep the axle bar 62, and structure 64, 66, etc., which it supports, centered between the molded halves 46 and 47 of housing body 45. With this arrangement, the rotating display piece is prevented from shifting laterally to contact the housing 45. The bar magnet 60 is sized in length so as to turn freely between the arms 57 and 58 of the soft iron core, but the clearance here is only small so that the air gaps in the magnetic flux are quite narrow. Thus, power losses are kept to a practical minimum. By molding the core from iron powder and sintering it after molding, it can be produced very cheaply and its magnetic properties are very good. The continuous flux path provided by core 56 and its arms 57 and 58, and on through the bar magnet 60 is an important and efficient contributor to economical shifting of the display pieces 50.

The halves 46 and 47 of housing 45 are identical and interchangeable. Each has an aligning hole 95 and an aligning pin or dowel 96 at its upper or front end, FIG. 9. Similar aligning pin and hole arrangements are shown at the rear end so that when two of these parts are brought together, they are held in perfect alignment. The latter parts, at the rear, may sometimes be omitted. Each has also a half-opening 97 on either side so that when the two half housings are brought together, they form a round hole to accommodate a fastening device, i.e. the body of a shoulder screw 101. See FIG. 4, middle part. Screws 98 pass through holes 91 in the support panel 36 and through the openings 97, just mentioned, and are threaded into the core 56, etc., which is bored and tapped at 99 to receive them. See FIGS. 15 and 16. By these means, the housing 45 and all the parts it contains are securely fastened through the core piece 56, to the supporting panel behind it. This assures alignment of all parts and free rotation of the display piece 50 at all times. By using the metal core piece as a holder, the need for other metal parts, which probably would have to be cast into the housing parts 46 and 47, is eliminated. This is an important step in reducing costs.

The front face portions 86 of housing members 46 and 47, see FIG. 9, lie in the same plane when the parts are assembled, as just described. See FIGS. 3 and 4. Also, the black face plate or part 64 of each element 20 lies essentially in the same plane when it is turned outward, as seen in FIG. 7. Then when a support panel 36 is fully fitted with elements 20, as in FIGS. 1 and 4, the front surface is essentially or substantially continuous. The only significant exceptions are small truncated corners or corner cut-outs indicated at 100, middle part of FIG. 4. See also FIGS. 3 and 4. These are useful, however, being provided so that, if desired, fastening screws 101, passing through the composite openings 97 in the bottom flange of the housing or body element, FIG, 9, and placed in holes 39 of the support panel 36, may be reached from the front by an appropriate tool such as a slender screw driver, or an "Allen" or "Hex" wrench, and driven into a nut 102 in a supporting structure 103 to hold the module 15 in place in a display sign. This type of fastening has been mentioned in connection with FIG. 11, above.

Referring now to FIGS. 17 to 24, preferred arrangements are shown for fastening modules or groups of modules to a basic support structure. Means are included for enclosing the electric lead wires W.

Figure 17:
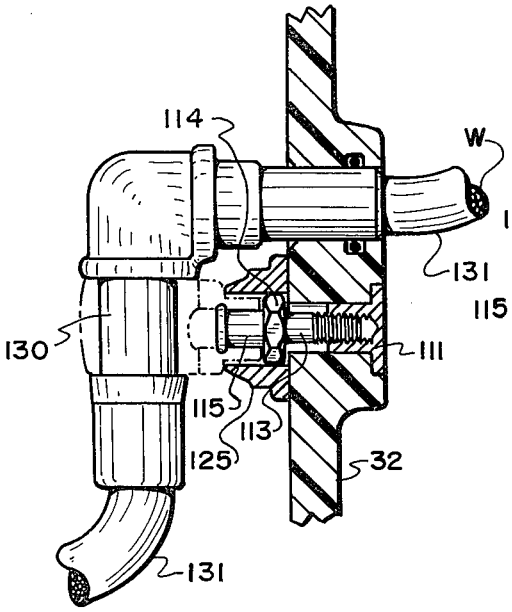
FIG. 17 is a fragmentary view, partly in section, showing a preferred method of mounting the electric lead wire conduit to the modules.
Figure 18:
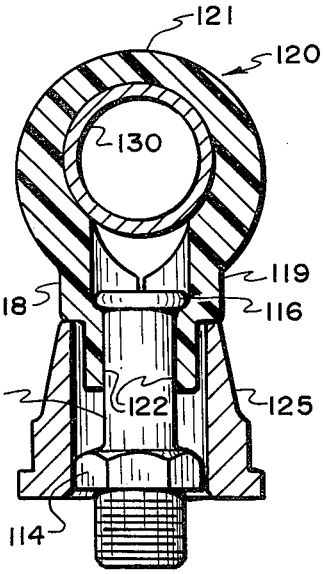
FIGS. 18 and 19 are enlarged sectional views through a mounting element having parts in two different positions.
Figure 19:
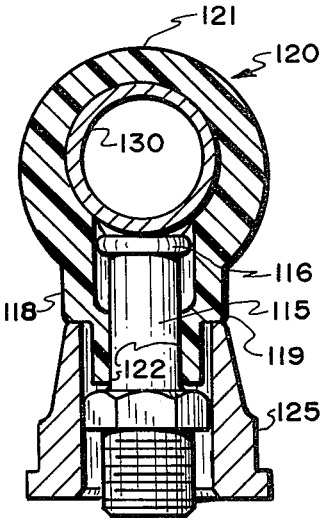

FIG. 17 shows part of a rear panel 32 (or it may be a mounting panel 35, see FIGS. 4 and 5) supported by a novel structure which is a preferred feature of the present invention. An internally threaded sleeve 111 is mounted in a neatly fitting hole in member 32. A bolt 113 has its threaded end screwed into sleeve 111. It has a hexagonal part 114 between its threaded end and a cylindrical part 115 which extends upwardly in FIGS. 18 and 19, terminating in an upper rib or flange 116. The latter is adapted to be engaged in an internal bore or sleeve formed between two separable legs 118, 119 or a bifurcate connector 120. The latter is of the general type described and claimed in detail in U.S. Pat. No. 3,633,250. Its legs 118 and 119 are joined by a somewhat elastic loop 121 which is capable of being flexed or straightened enough to permit flange 116 or be inserted between them when, but only when, there is no ferrule surrounding the lower parts 122 of legs 118 and 119. In assembled position, as shown in FIGS. 17 to 19, these legs are surrounded by a ferrule 125 and cannot be separated. Hence flange 116 holds bolt 113 captive between legs 118 and 119. See FIG. 22.

Figure 20:
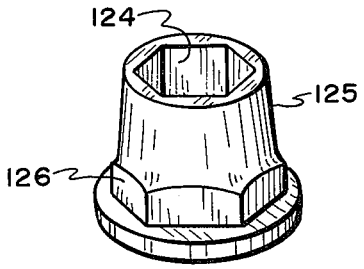
FIG. 20 is a perspective view of a mounting ferrule.

As shown best in FIG. 20, the sleeve or ferrule 125 has an internal hexagonal opening 124 which fits neatly around the nut part 114 of the bolt. Ferrule 125 also has an external hexagonal base 126 so that it can be engaged by a wrench for turning. With a bolt 113 inside, the latter can be threaded into or out of the internally threaded sleeve 111. FIG. 18 shows it threaded into place whereas FIG. 19 shows it unscrewed.

Through the loop 121 of the bifurcate connector 120, a conduit 130 may be passed. Through such conduits the lead wires W may be passed to a power supply and control system, not shown. The wires which will be numerous in a complex sign, are shown grouped together in a cable 131, FIG. 17.

Figure 21:
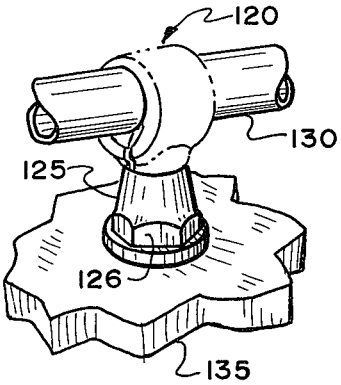
FIG. 21 is a view, partly in phantom, of a mounting element supported on a tube or conduit.

FIG. 21 shows the conduit or tube 130 above the structure 135, which may be the top wall of a sign assembly. In this case, tube 130 serves only as a support but electric wires, etc., may be passed through it, if desired.

Figure 24:
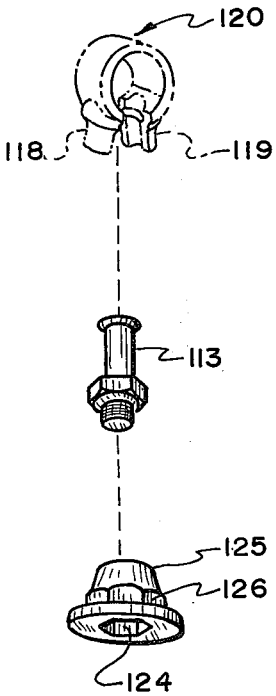
FIG. 24 is an exploded view of the fastening parts of FIG. 21.
Figure 22:
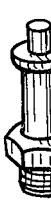
FIG. 22 is a perspective detail view of an internal fastening element.
Figure 23:
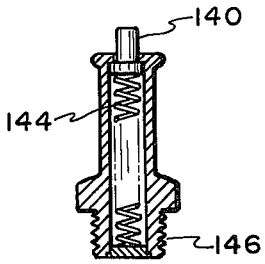
FIG. 23 is a vertical sectional view of a modification of FIG. 22.

FIG. 23 shows a top extension 138 on a bolt 113 which is otherwise much like the bolt of FIGS. 17 to 19. Instead of being able to retract the bolt completely into the sleeve by turning the ferrule, as in FIG. 19, the extension 138 serves as a limit stop to make sure the threaded projection of the hexagonal nut 114 is out of sleeve 125, so it can be screwed into the structure. FIG. 23 shows a limit stop pintle 140 in the upper part of the bolt body 142, which is hollow in this case. A compression coil spring 144 urges pintle 140 upwardly and its reaction force tends to hold the bolt down so that its threaded end 146 can conveniently be engaged in a threaded opening, e.g., as in sleeve 111, FIG. 17, or in any other member to be engaged by it. FIG. 24 is an exploded view of the structure of FIGS. 18, 19, and 21.

Figure 12:
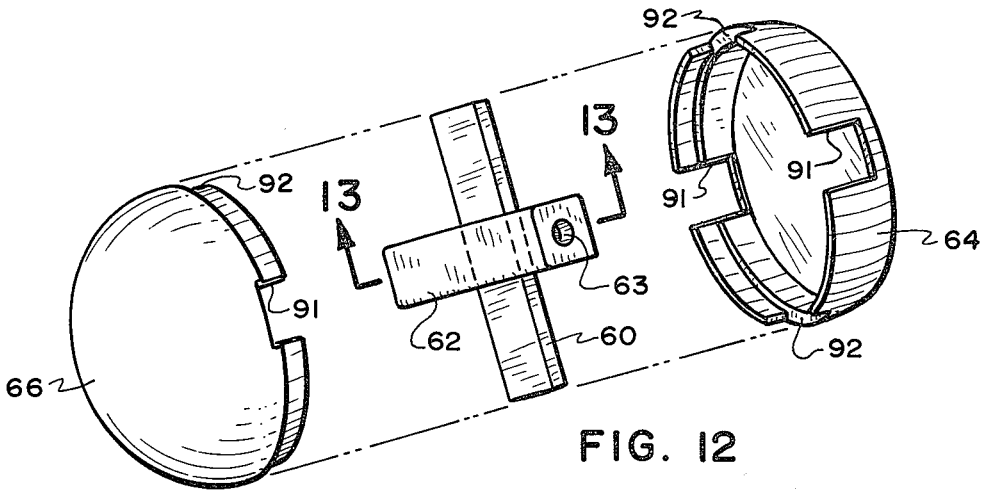
FIG. 12 is an exploded view of the display piece per se.
Figure 13:
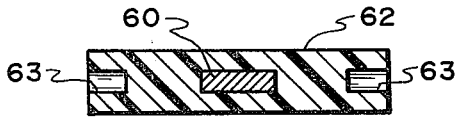
FIG. 13 is a sectional view of a core or support block part of the display piece, being taken substantially along the line 13—13 of FIG. 9.

Referring now to FIGS. 12 and 15 the light-showing or light-reflecting surfaces 66 on rotatable elements 50 are shown as being substantially hemispherical in their outer surfaces. This is advantageous in many cases. Covered with efficient light-reflective material, such as fine reflective beads or equivalent material, they pick up light coming from various directions and reflect it forward very effectively, so it can be seen from front positions and at various angles to the sign. In some cases it may be desirable to form the lighting surfaces 66 with multiprism shapes, as in certain conventional reflectors. For convenience in molding, the center of the spherical or partly spherical outer surface 66 is located somewhat below the plane of outer rabbet joint 104, FIG. 14, preferably about at the plane of the axle block hole center 63. This avoids the undesirable small lip commonly encountered in molding full hemispheres, due to limitations on mold shapes at the equator line in a spherical mold.

The readability of the display sign described above is excellent without intrinsic illumination. Lights from other sources, such as approaching automobiles or other vehicles, and from various other directions and sources which may be at considerable angles away from direct front, it picked up good reflectorized material and is returned profusely. The rounded front shape for the front face 66 of pieces 50, has distinct advantages over plane or near plane surfaces. As indicated above, prismatic surfaces may be substituted, preferably approximating the rounded shapes shown, with excellent effect in many cases. By contrast the dark rear faces 64 of the pieces 50 are preferably flat, non-reflective, and they lie in the display plane or very nearly so.

The light-emitting surfaces 66 may be enhanced in efficiency in some cases by coating them with phosphorescent materials so that they will continue to glow after exposure to oncoming light from any source. In other cases, it may be desirable to coat them with fluorescent materials, or with materials which are luminous when subjected to invisible forms of radiation, such as infra-red, ultraviolet or so-called "black" light, and the like. In general terms, the effective, visible surfaces 66 may be referred to as "lighted" or light-showing surfaces, regardless of the source or nature of the light shown, while the back face or non light-showing surface 64 is referred to as "dark" or "black." To display intelligible reading matter, such as numerals, letters and words, it is merely necessary to use a control means that will produce the proper signals, with proper polarity, and at the right time, selectively to turn the desired pattern of lighting elements 66 forward and to make sure that all the undesired areas are black. As suggested above, by operating the controls in a sequence rather than simultaneously, so that only one or a very few elements are being turned at any given instant, the power requirements may be kept very low, even with rapidly changing display matter.

It will be appreciated that the light-showing elements 66 of any single module 15 will be aligned into a general surface which may be considered broadly the "plane" of the display. In using the term "plane," it is not intended to require that the viewing surface be in fact planar or smooth; it may well be somewhat curved or double curved, e.g., spherical. The visible elements lie in the general locus of this continuing surface. When they are convex, as is preferred, the most forward points of all the elements 66 then will lie in an envelope which is either at the viewing surface or is slightly in front of or parallel (or concentric) to it. As each module normally represents a single symbol (i.e., a single letter of the alphabet or an arabic numeral) the elements necessary to clearly represent that symbol will be facing outwardly; all others will be turned in to expose the black or dark face. The term "viewing surface," thus is to be interpreted broadly as the general locus of the light-showing elements and of the dark elements as well.

It will be self-evident that the various modifications suggested above are, in general, equivalents of each other and it will be apparent to those skilled in the art that other variations substitutions, etc., may be made without departing from the spirit and purpose of the invention. It is intended by the claims which follow to cover these equivalents, variations, modifications and changes as broadly as the state of the prior art properly permits.

What is claimed is:

1. Apparatus for displaying intelligence in groups of intelligible symbols such as alphabetic and/or numerical symbols and the like, which comprises, in combination:

a. A multiplicity of similar modules mounted adjacent each other in rows and columns and each adapted to selectively display at least one of said symbols, said multiplicity of modules presenting a substantially continuous viewing area, in which b. each module comprises a plurality of individuallly changeable display elements assembled in multiple rows and columns in the module and wherein each element comprises a hollow housing consisting primarily of a pair of interchangeable and similar housing parts having a common plane base and adapted to be assembled on a diagonal plane perpendicular to said base to present an essentially square viewing face except for slight truncations at corners to provide access to mounting bolts or equivalent in said base, c. a rotatable face piece pivotally mounted in each of said housings adapted to present selectively a relatively visible or light-showing face or a relatively non-visible or dark face, in which each face piece incorporates a permanent magnet, and d. an electromagnet mounted within each said housing and comprising an iron core and a coil for selectively rotating said face piece in response to control signal from an electric power source, whereby selected ones of said face pieces in a module are turned to display an intelligible symbol in said module.

2. Apparatus according to claim 1 wherein the iron core in each element is provided with attachment parts for mounting said module elements on the module base.

3. Apparatus according to claim 1 in which each module comprises a mounting panel to which the said elements are secured individually, an opening being provided in said panel for electrical wires connecting to each said element, and a weather-proof housing enclosing said panel, with means for spacing the panel from a wall of said housing to contain said electrical wires between said panel and said wall.

4. Apparatus according to claim 1 in which each core comprises a substantially rectilinear base part, said coil wound around said base part, and means in the core on either side of said coil for receiving mounting bolts attaching the said element to a mounting panel.

5. Apparatus according to claim 1, in which each said element comprises a molded resin housing in two identical parts divided diagonally and surrounding said mobile piece with substantially dark and invisible surface areas of said housing lying in the viewing area, said two part housing being secured in the module through the iron core.

6. Apparatus according to claim 1 which includes a flanged mounting bolt threaded into a said module, a flexible bifurcate connector engaging the flange on said bolt between its bifurcate legs to prevent relative axial displacement of the bolt from the connector, and a sleeve surrounding said legs to hold them against separation so that they retain said flanged bolt between them.

7. Apparatus according to claim 6 in which the sleeve and the bolt have interengaging parts whereby turning said sleeve about its axis will also thread the bolt into or out of said module.

8. A display element for assembling with other similar elements in side by side and corner to corner relationship with the front faces of said assembled elements lying in a common plane or substantially so, said element comprising a pair of identical and interchangeable half-shell bodies assembled and interlocked to form a hollow element body, said assembled composite body having in its assembled state a substantially square cross section and provided internally with reception means to receive and hold accurately in position a display element, the corners of the front face of said composite body being truncated to provide access openings between the corners of said element and the adjacent corners of similar elements to accommodate an instrument for securing said composite body to a supporting base, thereby to facilitate the assembly of individual display elements to said base.

9. A display element according to claim 8 in which a rotatable non-selfluminous display part having respectively visible and relatively non-visible display surfaces is pivotally mounted in said assembled composite body.

10. A display element according to claim 9 in which the element also includes selectively operable electromagnetic means for rotating said display part selectively to a visible or non-visible aspect, thereby to alter the matter displayed by a plurality of said display elements when assembled together in said common plane.

* * * * *